US012012807B2

(12) United States Patent
Caraway

(10) Patent No.: US 12,012,807 B2
(45) Date of Patent: Jun. 18, 2024

(54) DRILL BIT WITH OFFSET COUNTER-ROTATING CUTTERS

(71) Applicant: Halliburton Energy Services, Inc., Houston, TX (US)

(72) Inventor: Douglas Bruce Caraway, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 227 days.

(21) Appl. No.: 17/538,750

(22) Filed: Nov. 30, 2021

(65) Prior Publication Data

US 2023/0167688 A1 Jun. 1, 2023

(51) Int. Cl.

| | |
|---|---|
| ***E21B 10/10*** | (2006.01) |
| ***E21B 10/14*** | (2006.01) |
| ***E21B 10/42*** | (2006.01) |
| ***E21B 10/43*** | (2006.01) |
| ***E21B 10/62*** | (2006.01) |

(52) U.S. Cl.

CPC ..... *E21B 10/10* (2013.01); *E21B 10/14* (2013.01); *E21B 10/42* (2013.01); *E21B 10/43* (2013.01); *E21B 10/62* (2013.01)

(58) Field of Classification Search

CPC ..... E21B 10/14; E21B 10/42; E21B 10/43; E21B 10/62; E21B 10/20; E21B 10/10; E21B 10/12

See application file for complete search history.

(56) References Cited

U.S. PATENT DOCUMENTS

| | | | | |
|---|---|---|---|---|
| 1,195,208 | A | 8/1916 | Griffin | |
| 1,374,867 | A * | 4/1921 | Wadsworth | E21B 10/12 175/227 |
| 1,657,609 | A * | 1/1928 | Crickmer | E21B 10/12 175/350 |
| 2,133,022 | A | 10/1938 | Fisher | |
| 2,524,428 | A | 10/1950 | Day et al. | |
| 2,975,849 | A * | 3/1961 | Stuart | E21B 10/04 175/339 |
| 3,860,292 | A | 1/1975 | Bechem | |
| 4,736,987 | A * | 4/1988 | Lenzen | B28D 1/18 125/5 |
| 4,815,543 | A * | 3/1989 | Lenzen | B23Q 5/04 175/398 |
| 10,557,311 | B2 | 2/2020 | Anderle et al. | |
| 10,876,360 | B2 | 12/2020 | Grosz | |
| 10,995,557 | B2 | 5/2021 | Grosz et al. | |

* cited by examiner

*Primary Examiner* — Blake Michener

(74) *Attorney, Agent, or Firm* — Michael Jenney; C. Tumey Law Group PLLC

(57) ABSTRACT

A drill bit is provided. The drill bit includes a bit body and an axle disposed in the bit body. The axle includes a first axle portion extending in a longitudinal direction and a second axle portion extending in the longitudinal direction. A longitudinal end of the first axle portion is continuous with a longitudinal end of the second axle portion. When viewed from the longitudinal direction, the first axle portion and the second axle portion are not coaxial, and an outer perimeter of the first axle portion is located entirely within an outer perimeter of the second axle portion. The drill bit also includes a first cutter disposed on the first axle portion and a second cutter disposed on the second axle portion.

17 Claims, 12 Drawing Sheets

DRILL BIT WITH OFFSET COUNTER-ROTATING CUTTERS

TECHNICAL FIELD

The present disclosure relates generally to drill bits and, more particularly, to drill bits with offset counter-rotating cutters.

BACKGROUND

Often in operations for the exploration, drilling and production of hydrocarbons, water, geothermal energy or other subterranean resources, a rotary drill bit is used to form a wellbore through a geologic formation. Rotary drill bits may generally be classified as either fixed-cutter drill bits or roller-cone drill bits, either of which may be installed at the end of a drill string and rotated (hence, rotary) to cut the formation. Whether to use a fixed-cutter bit or a roller-cone bit depends on the particular formation and cost/performance objectives, as the two types perform differently in different types of formations.

Fixed-cutter drill bits are often referred to as "drag bits" due to having a plurality of cutters mounted to the bit body at fixed positions. The bit body for a fixed-cutter drill bit may be constructed of a metallic material such as steel or a matrix material formed by infiltrating a reinforcement material with a molten binder. The cutters can be affixed to an outer profile of the bit body such that hard surfaces on the cutters are exposed to the geologic formation when forming a wellbore. The cutters generally operate to remove material from the geologic formation, typically by shearing formation materials as the drill bit rotates within the wellbore.

Roller-cone drill bits may be constructed of one or more roller cones rotatably mounted to the bit body, wherein cutters mounted at fixed positions on the roller cones rotate with the roller cones. The roller cones roll along the bottom of a wellbore in response to rotation of the roller-cone drill bit at the end of the drill string. The cutters on the roller cones generally operate to remove material from the geologic formation, typically by crushing, gouging and/or scraping material from the geologic formation to drill the wellbore. Hybrid drill bits have been developed with features of both fixed-cutter and roller-cone drill bits for various purposes. For example, in some instances, a hybrid drill bit may be more durable, thereby permitting greater depths to be drilled before requiring maintenance or replacement of the drill bit than either a fixed-cutter drill bit or roller-cone drill bit alone.

BRIEF DESCRIPTION OF THE DRAWINGS

Some specific exemplary aspects of the disclosure may be understood by referring, in part, to the following description and the accompanying drawings.

Figure 1:
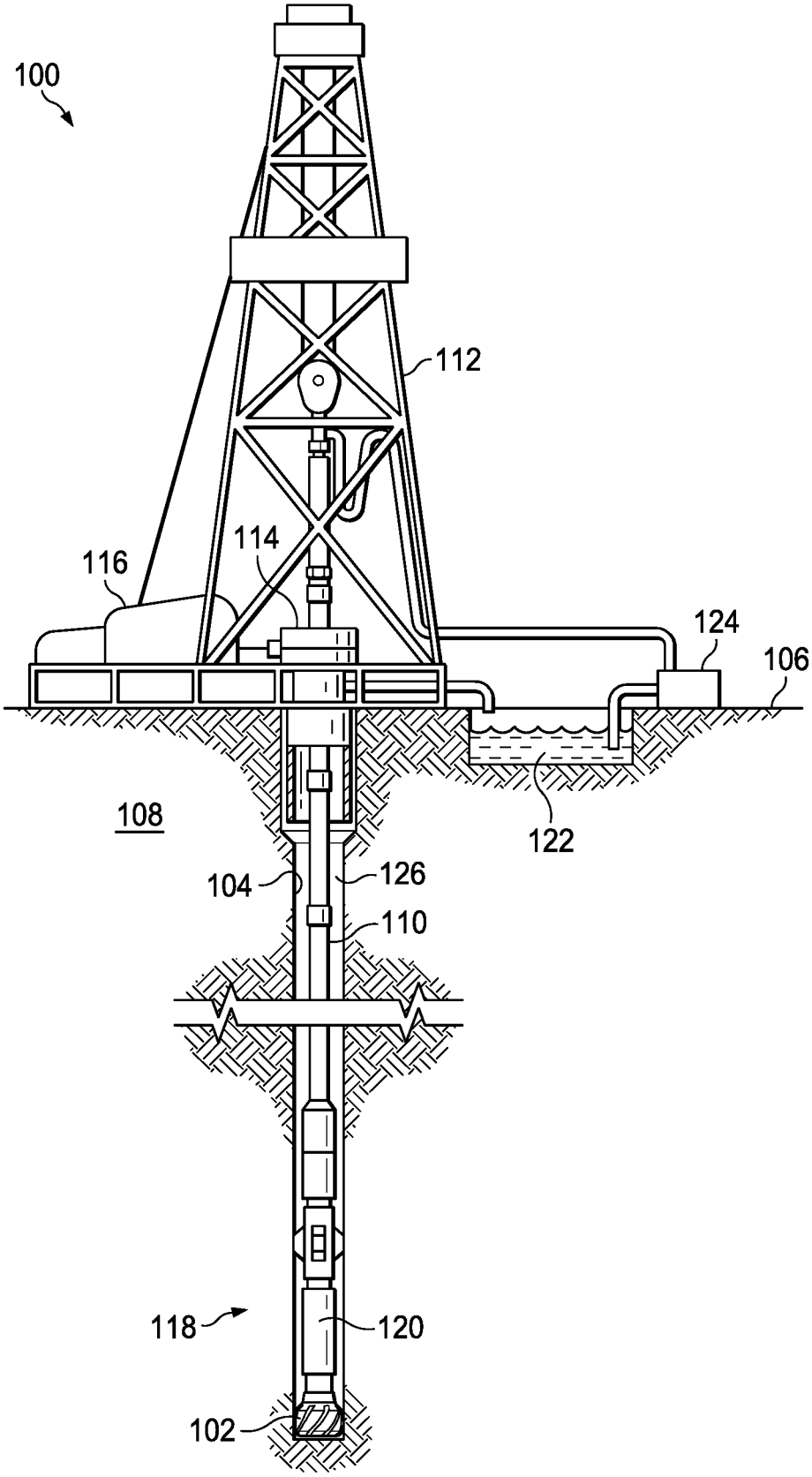
FIG. 1 is a schematic partial cross-sectional view of a drilling system incorporating a drill bit, in accordance with one or more aspects of the present disclosure.

While aspects of this disclosure have been depicted and described and are defined by reference to exemplary aspects of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described aspects of this disclosure are examples only, and not exhaustive of the scope of the disclosure.

DESCRIPTION OF CERTAIN EMBODIMENTS

Illustrative aspects of the present disclosure are described in detail herein. In the interest of clarity, not all features of an actual implementation may be described in this specification. It will of course be appreciated that in the development of any such actual aspect, numerous implementation specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

The present application relates to a drill bit, a cutter assembly for use in a drill bit, and a method for drilling a well using a drill bit. The disclosed drill bits include a cutter assembly with counter-rotating cutters that are offset from each other.

Counter-rotating cutters have been used in a variety of drill bits including roller-cone drill bits and hybrid drill bits, among others. In some cases, a single axle supports counter-rotating cutting members along the same centerline. This works well for drilling wells at a lower rate of penetration (ROP) and/or with bits smaller than 9 inches in total diameter. It is known that roller cone drill bits can provide faster, more aggressive drilling when the axles of the individual cutting members are offset from the centerline of the bit to induce more scraping action during rotation of the cutting elements. However, while attempts have been made to offset the axis of rotation for cutting members, the mechanisms require multiple parts that must be individually assembled and may not withstand the loads of drilling (particularly drilling larger wells).

The disclosed cutter assembly, drill bit, and method use a single axle to provide an offset to the cutting members instead of multiple components that require complex machining. The disclosed cutter assembly, drill bit, and method may enable more aggressive cutting action during drilling with a simplified axle assembly. The single axle of the disclosed cutter assembly, drill bit, and method may be easily produced using existing machining practices. The disclosed cutter assembly, drill bit, and method provide the potential for faster ROP while drilling wells with no significant cost increases for the construction of the drill bit.

Turning now to the drawings, FIG. 1 illustrates a drilling system 100 incorporating an exemplary drill bit 102. In some embodiments, the drilling system 100 is partially disposed within a wellbore 104 extending from a surface location 106 and traversing a subterranean formation 108. In the illustrated example, the wellbore 104 is shown generally vertical, though it will be understood that the wellbore 104 may include any of a wide variety of vertical, directional, deviated, slanted, and/or horizontal portions therein, and may extend along any trajectory through the subterranean formation 108.

The drill bit 102 is provided at a lower end of a drill string 110 for cutting into the subterranean formation 108. During formation of the well, the drill bit 102 may be lowered into the subterranean formation 108 and rotated. When rotated, the drill bit 102 operates to break up and generally disintegrate the subterranean formation 108, and the wellbore 104 is formed by cutting through the subterranean formation 108 with the rotating drill bit 102. The drill bit 102 may be rotated in any of a variety of ways. In this example, at the surface location 106 a drilling rig 112 includes a turntable 114 that may be operated to rotate the entire drill string 110 and the drill bit 102 coupled to the lower end of the drill string 110. The turntable 114 is selectively driven by an engine 116, chain-drive system, or other apparatus.

In some embodiments, a bottom hole assembly (BHA) 118 provided in the drill string 110 may include a rotary steerable system or downhole motor 120 to selectively rotate the drill bit 102 with respect to the rest of the drill string 110. In some aspects where a motor is used, the motor 120 may generate torque in response to the circulation of a drilling fluid, such as mud 122, therethrough. As those skilled in the art will recognize, the ability to selectively rotate the drill bit 102 relative to the drill string 110 may be useful in directional drilling, and/or for other operations as well. The mud 122 may be pumped downhole by mud pump 124 through an interior of the drill string 110. Thus, the mud 122 passes through the downhole motor 120 of the BHA 118 where energy is extracted from the mud 122 to turn the drill bit 102. As the mud 122 passes through the BHA 118, the mud 122 may lubricate bearings defined therein before being expelled through nozzles defined in the drill bit 102. The mud 122 works to flush geologic cuttings and/or other debris from the path of the drill bit 102 as it continues to circulate back up through an annulus 126 defined between the drill string 110 and the subterranean formation 108. The geologic cuttings and other debris are carried by the mud 122 to the surface location 106 where the cuttings and debris can be removed from the mud stream.

In other aspects, where a rotary steerable system is used, the system may be programmed by a measurement while drilling (MWD) engineer or directional driller who transmits commands using surface equipment (typically using either pressure fluctuations in the mud column or variations in the drill string rotation) which the system responds to, and gradually steers into the desired direction. That is, the rotary steerable system may be designed to drill directionally with continuous rotation from the surface, eliminating the need to pass the mud through a motor.

Figure 2A:
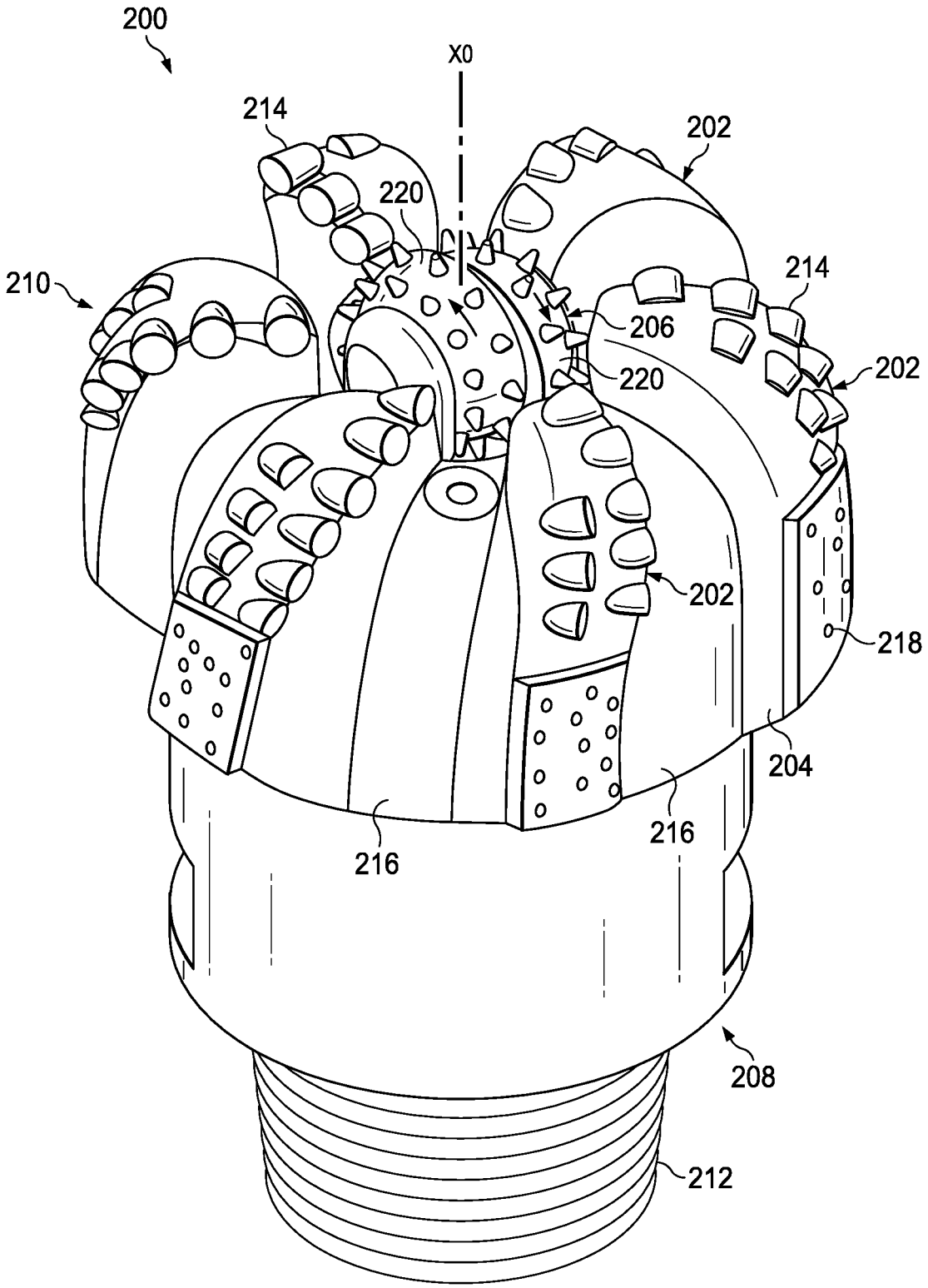
FIGS. 2A and 2B are perspective views of examples of the drill bit of FIG. 1, including a plurality of blades defined by a drill bit body and a rolling cutter assembly, in accordance with one or more aspects of the present disclosure.
Figure 2B:
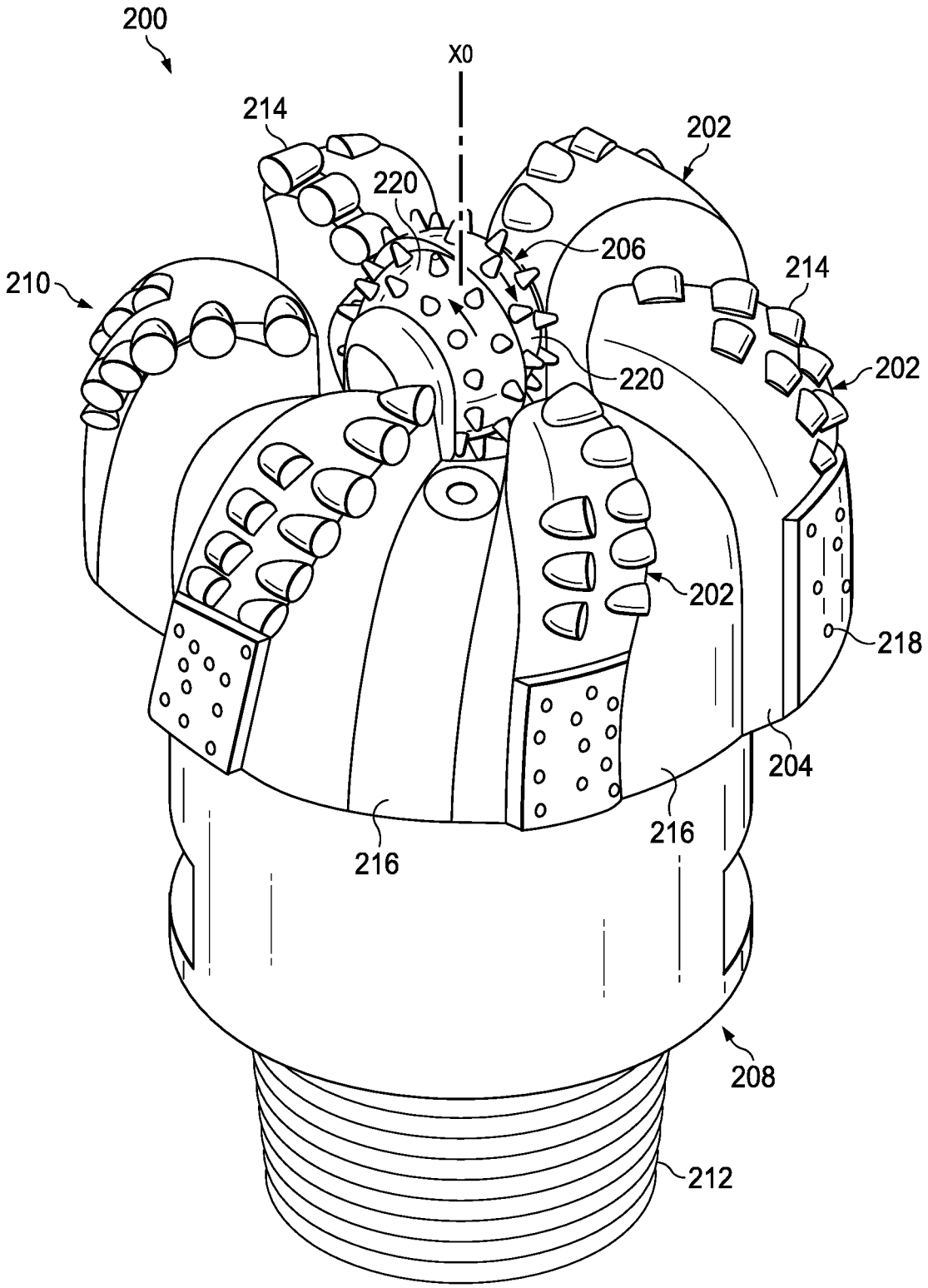
Figure 3:
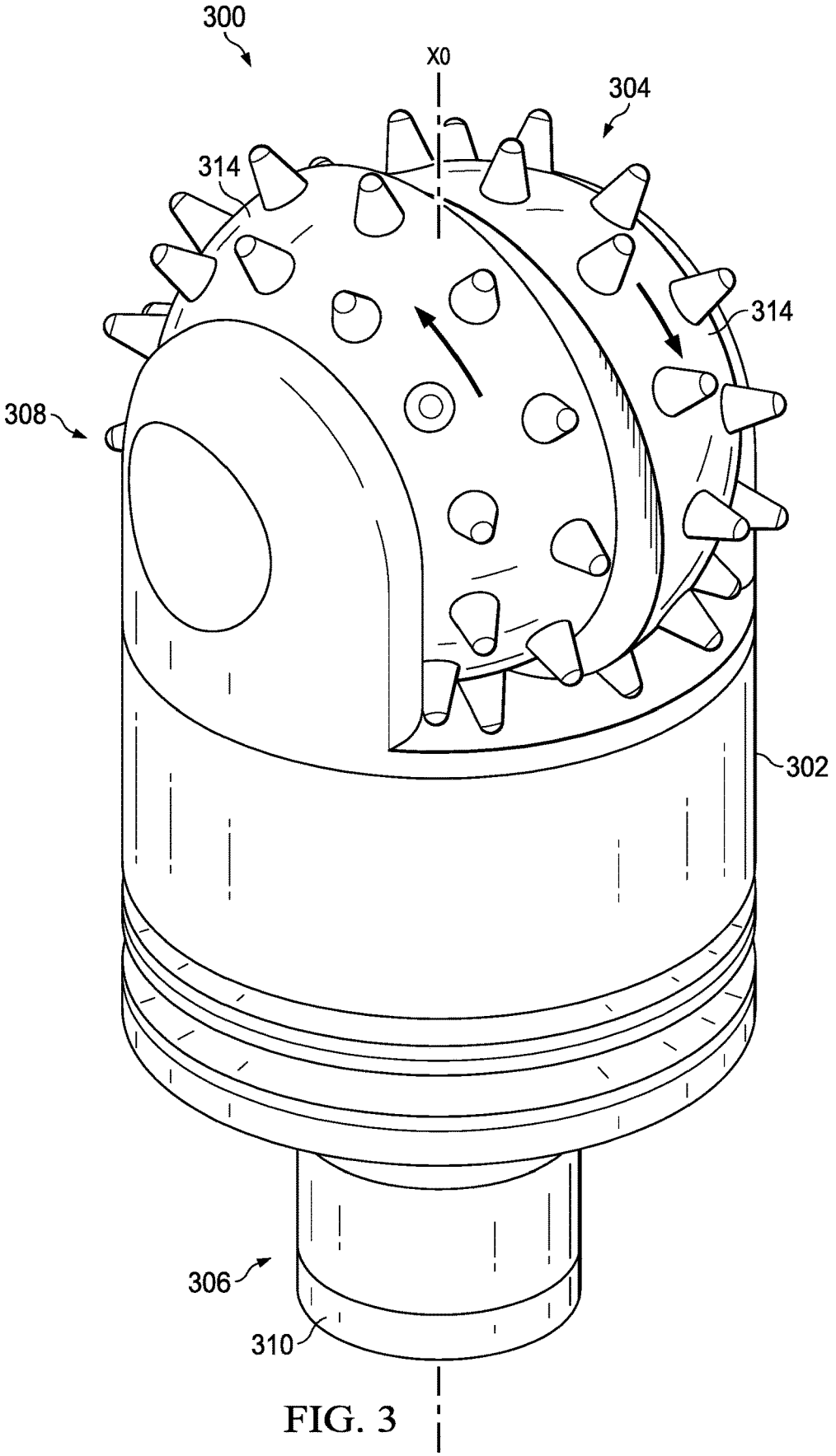
FIG. 3 is a perspective view of another example of the drill bit of FIG. 1, in accordance with one or more aspects of the present disclosure.

The drill bit 102 used in the drilling system 100 of FIG. 1 may take many forms, including that of a hybrid drill bit (shown in FIGS. 2A and 2B) or a rotating cutter drill bit (shown in FIG. 3). In disclosed embodiments, the drill bit 102 may include a rotating cutter assembly having two cutters disposed along and rotatable about an axle with an offset between the rotational axes of the cutters.

FIGS. 2A and 2B illustrate example hybrid drill bits 200 that may be used in the drilling system 100 of FIG. 1. The hybrid drill bits 200 may include a plurality of cutting blades 202 defined by a bit body 204 and a rolling cutter assembly 206 circumscribed by the plurality of cutting blades 202.

As illustrated in FIG. 2A, the hybrid drill bit 200 may include the bit body 204 having a rotational axis X0, an aperture in which the rolling cutter assembly 206 is positioned, and a lower end portion 210. The hybrid drill bit 200 may further include a plurality of blades 202 at the lower end portion 210, and an upper connector section 208 for coupling to a lower end of the drill string (e.g., 110 of FIG. 1). The drill bit 200 may also include a connector 212 extending from the bit body 204 and disposed at the upper connector section 208 of the drill bit 200. The connector 212 can be configured in accordance with any of various types of connectors for coupling the hybrid drill bit 200 to the drill string (e.g., 110 of FIG. 1). In some embodiments, the connector 212 may include a threaded pin with American Petroleum Institute (API) threads defined thereon.

In some embodiments, the bit body 204 may be constructed of matrix material formed by infiltrating a reinforcement material, e.g., tungsten carbide powder with a molten binder material, e.g., copper, tin, manganese nickel and zinc as appreciated by those skilled in the art. Alternatively, the bit body 204 may be constructed of a metallic material such as steel or any of various metal alloys generally associated with manufacturing rotary drill bits.

In accordance with some embodiments, the plurality of blades 202 may extend radially from the bit body 204 about the rotational axis X0 at the lower end portion 210 of the bit body 204. Each of the plurality of cutting blades 202 may include a plurality of cutting elements 214 embedded therein. The hybrid drill bit 200 may also include junk slots 216 defined between the cutting blades 202. In some embodiments, the cutting blades 202 are asymmetrically arranged about the bit body rotational axis "X0." The junk slots 216 facilitate the removal of geologic materials and debris from the path of the hybrid drill bit 200, e.g., by providing a flow path for drilling mud (e.g., 122 of FIG. 1) around the bit body 204. The cutting elements 214 are mounted for maintaining a position and orientation with respect to the bit body 204 as the hybrid drill bit 200 is rotated about the bit body rotational axis "X0." In operation, the cutting elements 214 engage and remove adjacent portions of the subterranean formation (e.g., 108 of FIG. 1), generally by shearing the geologic materials from the bottom and sides of the wellbore (e.g., 104 of FIG. 1) as the hybrid drill bit 200 rotates downhole.

In some embodiments, the cutting elements 214 may include various types of polycrystalline diamond compact (PDC) cutter components. Gauge elements 218 are provided on radially outward facing surfaces at a trailing end of each cutting blade 202. The gauge elements 218 may be constructed of any of the hard materials described above for construction of the cutting elements 214 and operate to maintain a diameter of the wellbore (e.g., 104 of FIG. 1).

In addition to the cutting blades 202 with their cutting elements 214, the hybrid drill bit 200 includes the rolling cutter assembly 206. In some embodiments, the rolling cutter assembly 206 may be a pair of rotational cutters 220 configured to be inserted into the central bore toward the lower end portion 210 of the bit body 204. The cutters 220 are designed to rotate (e.g., in opposite directions) around their corresponding rotational axes in response to the rotation of the hybrid drill bit 200 and the movement of drilling mud (e.g., 122 of FIG. 1) around the bit body 204. In operation, the rotating cutters 220 engage and remove adjacent portions of the subterranean formation (e.g., 108 of FIG. 1), generally by shearing the geologic materials from the bottom of the wellbore (e.g., 104 of FIG. 1) as the hybrid drill bit 200 rotates downhole. As such, the wellbore (e.g., 104 of FIG. 1) is formed by the rotating cutters 220 (along with the cutting elements 214 on the cutting blades 202) cutting through the subterranean formation (e.g., 108 of FIG. 1). The drilling mud (e.g., 122 of FIG. 1) pumped through the drill bit 200 may lubricate the rotating cutters 220.

As illustrated, the cutters 220 are positioned with respect to each other such that their respective rotational axes are offset from one another (i.e., not concentric). This may enable the cutters 220 to induce more scraping against the subterranean formation than would be possible if they were aligned on the same rotational axis. In FIG. 2A, each cutter 220 may rotate (as indicated by arrows) in a direction toward the side of the cutter 220 that extends beyond an edge of its counterpart cutter 220. That is, the arrows may face the directions in which each of the cutters 220 are offset away from each other. That way, the ledge formed by the extended end of each cutter 200 trails that cutter's rotation. However, other orientations may be possible in other embodiments. For example, FIG. 2B illustrates another hybrid drill bit 200 that is generally the same as the drill bit 200 of FIG. 2A, except the cutters 220 are offset in an opposite direction such that the ledge formed by the extended end of each cutter 200 leads that cutter's rotation.

Disclosed embodiments (e.g., as shown in FIGS. 2A and 2B) include a rolling cutter assembly 206 in which the cutters 220 are offset from each other and disposed on one continuous axle. In particular, the cutter assembly 206 may include a first cutter 220 disposed on a first portion of the axle and a second cutter 220 disposed on a second portion of the axle, wherein the first and second portions of the axle are not coaxial. Various arrangements of the axle and the offset cutters are described below with reference to FIGS. 4A-10. Any combination of these axles and offset cutters may be used in the hybrid drill bit 200 shown in either of FIGS. 2A and 2B.

The disclosed cutter assembly may also be used in other types of drill bits, such as a rotating cutter drill bit that does not have blades with fixed cutting elements. For example, FIG. 3 illustrates a perspective side view of a rotating cutter drill bit 300 that may be used in the drilling system 100 of FIG. 1. The rotating cutter drill bit 300 may include a bit body 302 and a rolling cutter assembly 304. As illustrated, the rotating cutter drill bit 300 may include the bit body 302 having a rotational axis X0 and a lower end portion 308 in which the rolling cutter assembly 304 is located. The rotating cutter drill bit 300 may further include an upper connector section 306 for coupling to a lower end of the drill string with a connector 310. The bit body 302 may be constructed from similar material(s) as the bit body 204 described above with reference to FIGS. 2A and 2B.

The rolling cutter assembly 304 may have substantially the same construction and operation of the rolling cutter assembly 206 of FIGS. 2A and 2B. In particular, the rolling cutter assembly 304 may be a pair of rotational cutters 314 designed to rotate (e.g., in opposite directions) around their corresponding rotational axes. These cutters 314 may be the primary cutters or the only cutters in the rotating cutter drill bit 300. Using the drill bit 300 of FIG. 3, a wellbore (e.g., 104 of FIG. 1) may be formed entirely by the rotating cutters 314, without the aid of additional cutting elements (e.g., like in the hybrid drill bit 200 of FIGS. 2A and 2B). The rolling cutter assembly 304 of FIG. 3 has the cutters 314 offset from each other and disposed on one axle. Various arrangements of the axle and the offset cutters are described below with reference to FIGS. 4A-10. Any combination of these axles and offset cutters may be used in the rotating cutter drill bit 300 of FIG. 3.

In either embodiment shown in FIGS. 2 and 3, the drill bit 200, 300 may have an outer diameter (in a direction perpendicular to axis X0) of between approximately 6 inches and 36 inches. In some embodiments, the drill bit 200, 300 may have an outer diameter of between approximately 9 inches and 30 inches, more particularly between 12 inches and 24 inches.

In the following FIGS. 4A-11B and their descriptions, the axles, rotatable cutters, and drill bits are described with reference to a 3-dimensional coordinate system having an x-direction, a y-direction, and a z-direction as shown in the figures.

Figure 4A:
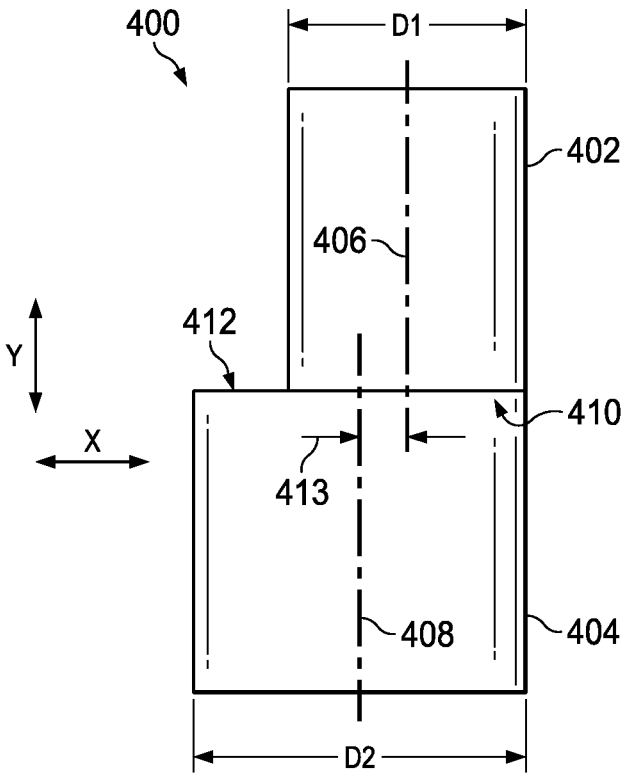
FIGS. 4A and 4B are top and side views of an example axle for a rolling cutter assembly of a drill bit, in accordance with one or more aspects of the present disclosure.
Figure 4B:
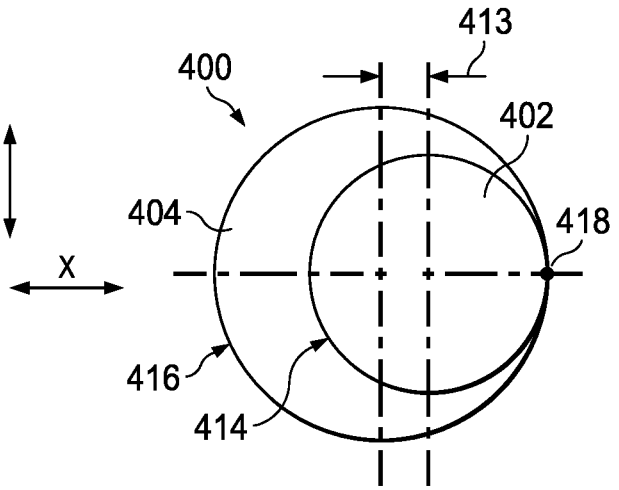

FIGS. 4A and 4B illustrate an example axle 400 that may be used in the cutter assemblies 206 and 304 of FIGS. 2 and 3, respectively. The axle 400 is configured to be disposed in a bit body (e.g., 204, 302 of FIGS. 2, 3). The axle 400 includes a first axle portion 402 and a second axle portion 404. The first axle portion 402 may extend in a longitudinal direction (i.e., parallel to the y-direction) along a first longitudinal axis 406. The second axle portion 404 may extend in the same longitudinal direction (i.e., parallel to the y-direction) along a second longitudinal axis 408. As shown in FIG. 4A, a longitudinal end 410 of the first axle portion 402 is continuous with a longitudinal end 412 of the second axle portion 404. The axle 400 may be a single continuous component. The axle 400 may be constructed from the same solid piece of material. That is, the axle 400 may be machined from one piece of material to form both the first and second portions 402, 404 thereof. The "ends" 410 and 412 of the axle portions 402 and 404 therefore may be continuous where the ends meet.

FIG. 4B shows the axle 400 of FIG. 4A as viewed from the longitudinal direction (i.e., parallel to the y-direction). As depicted in FIG. 4B, the first axle portion 402 and the second axle portion 404 are not coaxial. That is, the first longitudinal axis 406 and the second longitudinal axis 408 are not aligned with each other in the X-Z plane of FIG. 4B. Instead, the first longitudinal axis 406 and the second longitudinal axis 408 are offset from each other when viewed from the longitudinal direction. FIGS. 4A and 4B illustrate such an offset 413 between the two axle portions 402, 404.

In addition to not being coaxial, one axle portion is encompassed by the other when viewed from the longitudinal direction (e.g., FIG. 4B). For example, the outer perimeter 414 of the first axle portion 402 is located entirely within an outer perimeter 416 of the second axle portion 404. That is, all points along the outer perimeter 414 of the first axle portion 402 overlap with corresponding points on the longitudinal end 412 of the second axle portion 404. As illustrated in FIG. 4B, the first axle portion 402 may have a circular cross section, and the second axle portion 404 may have a circular cross section. In the illustrated embodiment of FIGS. 4A and 4B, the first axle portion 402 has a diameter D1 that is smaller than a corresponding diameter D2 of the second axle portion 404.

As illustrated in FIG. 4B, at least a point 418 on the outer perimeter 414 of the first axle portion 402 may intersect the outer perimeter 416 of the second axle portion 404. That is, the axle 400 may include one piece of material that is machined to two different diameters D1 and D2 which are tangent to each other at the point 418.

The axle 400 may be constructed from steel or a steel alloy in some embodiments. In other embodiments, the axle 400 may be constructed from tungsten carbide or a metal matrix composite (MMC) including tungsten carbide, which provides a good bearing surface, strength, and abrasion resistance. The same or similar materials may be used to form axles having any other shapes described with reference to FIG. 5A, 5B, or 8A-8C below.

Figure 5A:
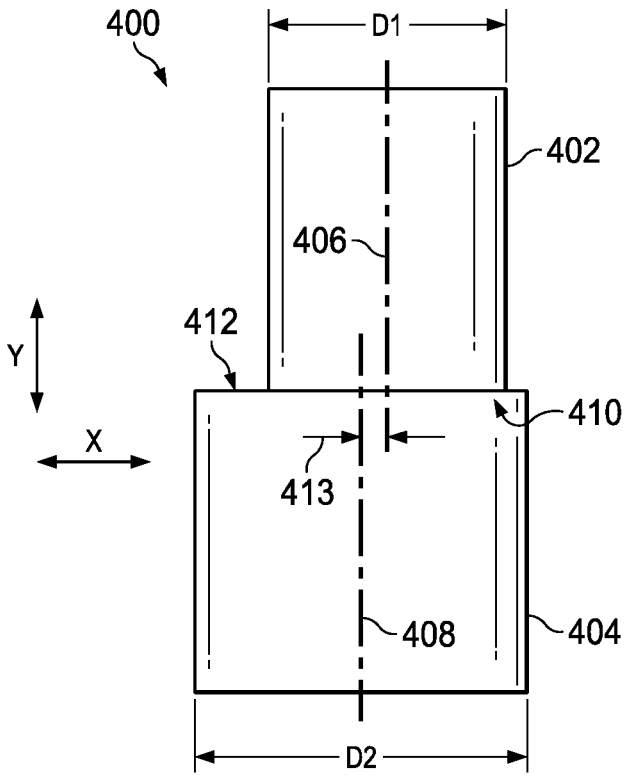
FIGS. 5A and 5B are top and side views of another example axle for a rolling cutter assembly of a drill bit, in accordance with one or more aspects of the present disclosure.
Figure 5B:
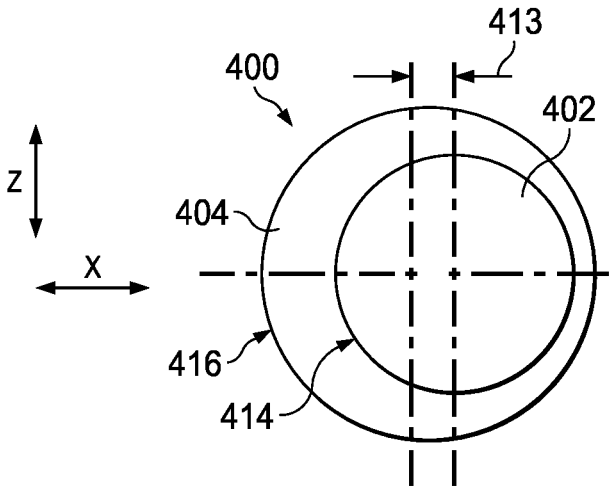

FIGS. 5A and 5B illustrate another example axle 400 that may be used in the cutter assemblies 206 and 304 of FIGS. 2 and 3, respectively. The axle 400 in FIGS. 5A and 5B is the same as the axle 400 in FIGS. 4A and 4B, except that the first axle portion 402 does not share a tangent with the second axle portion 404. That is, when viewed from the longitudinal direction (as shown in FIG. 5B), no point along the outer perimeter 414 of the first axle portion 402 intersects the outer perimeter 416 of the second axle portion 404.

Figure 6A:
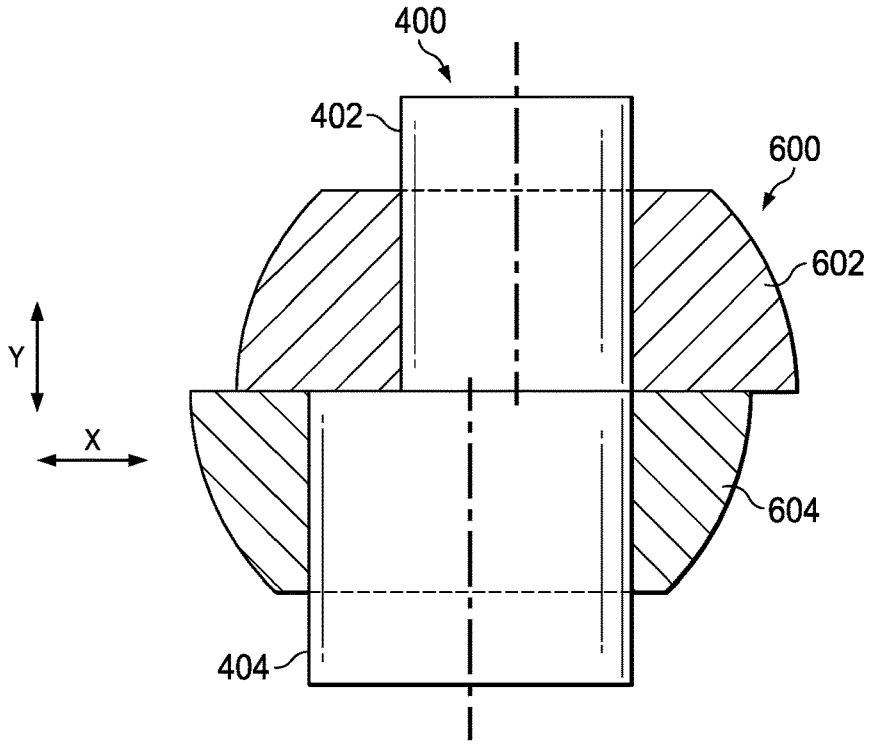
FIGS. 6A and 6B are partial cross-sectional top and side views of an example rolling cutter assembly having the axle of FIGS. 4A and 4B, in accordance with one or more aspects of the present disclosure.
Figure 6B:
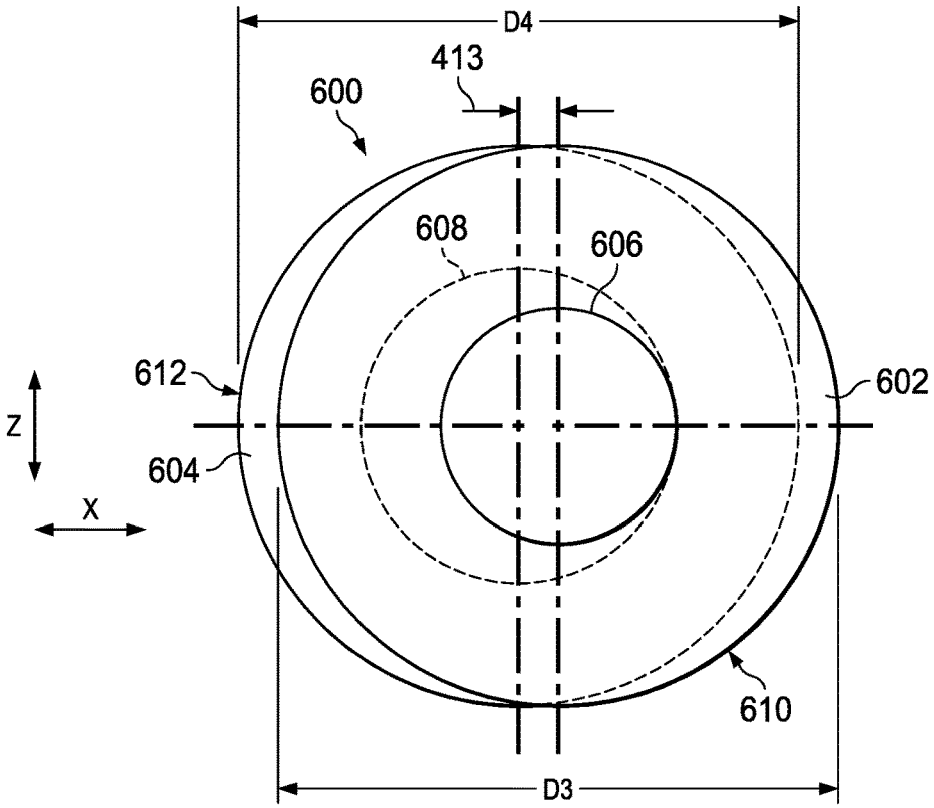

FIGS. 6A and 6B illustrate an example of a cutter assembly 600 having the axle 400 of FIGS. 4A and 4B with two rotatable cutters 602 and 604 disposed thereon. The first cutter 602 is disposed on the first axle portion 402, while the second cutter 604 is disposed on the second axle portion 404. The first cutter 602 may be rotatable about the first axle portion 402, while the second cutter 604 may be rotatable about the second axle portion 404. The cutters 602, 604 may be configured to rotate in opposite directions from each other with respect to their corresponding axle portions 402, 404.

Both cutters 602, 604 may be generally annular in shape. A radially inner edge 606 of the first cutter 602 is positioned around the first axle portion 402 of the axle 400, and a radially inner edge 608 of the second cutter 604 is positioned around the second axle portion 404 of the axle 400. The first cutter 602 may have a cutting edge 610 formed along its radially outer edge opposite the radially inner edge 606. Similarly, the second cutter 604 may have a cutting edge 612 formed along its radially outer edge opposite the radially inner edge 608. As shown in FIG. 6A, the cutting edge 610 of the first cutter 602 may be offset from the cutting edge 612 of the second cutter 604. For example, the cutting edge 610 may be offset from the cutting edge 612 on two opposing sides of the cutter assembly 600 by an amount equivalent to the distance of the offset 413 between the longitudinal axes of the first and second axle portions 402, 404. When viewed from the longitudinal direction in FIG. 6B, an outer diameter D3 of the first cutter 602 may be substantially equal to an outer diameter D4 of the second cutter 604.

Figure 7:
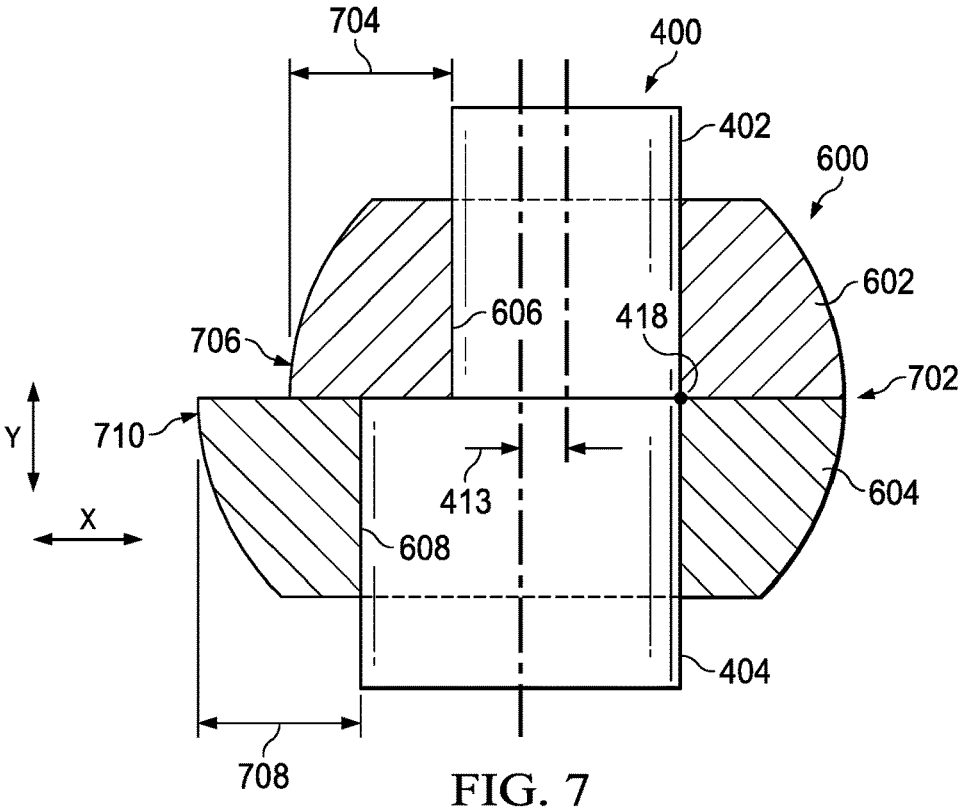
FIG. 7 is a partial cross-sectional top view of another example rolling cutter assembly having the axle of FIGS. 4A and 4B, in accordance with one or more aspects of the present disclosure.

FIG. 7 illustrates another example of a cutter assembly 600 having the axle 400 of FIG. 4A with two rotatable cutters 602 and 604 disposed thereon. The cutter assembly 600 in FIG. 7 is the same as the cutter assembly 600 in FIG. 6A, except that the cutters 602 and 604 are offset from each other on one side 700 of the cutter assembly 600 and are in alignment with each other on a second side 702 of the cutter assembly 600 opposite the first side 700. In the illustrated embodiment, the axle portions 402 and 404 share a tangent point 418 along the second side 702. In addition, a radial distance 704 from a radially outermost edge 706 to the radially inner edge 606 of the first cutter 602 is substantially equal to a radial distance 708 from a radially outermost edge 710 to the radially inner edge 608 of the second cutter 604.

Although FIGS. 6A and 7 show two possible arrangements of the cutter assembly 600, other arrangements may be provided in accordance with the present disclosure. For example, the cutters 602 and 604 may have unequal outer diameters D3 and D4 and/or unequal radial distances 704 and 708 between the radially outermost and radially inner edges thereof. In an example, the cutters 602 and 604 may have unequal outer diameters D3 and D4 and the offset 413 of the axle portions 402 and 404 may cause the cutters 602 and 604 to be offset on one side 700 and in alignment on another side 702 of the cutter assembly 600. In another example, the cutters 602 and 604 may have substantially equal radial distances 704 and 708 between the radially outermost and radially inner edges thereof, while the first axle portion 402 does not share a tangent with the second axle portion 404 (e.g., as in FIGS. 5A and 5B). Other combinations of these arrangements may be possible without departing from the scope of the present disclosure.

Figure 8A:
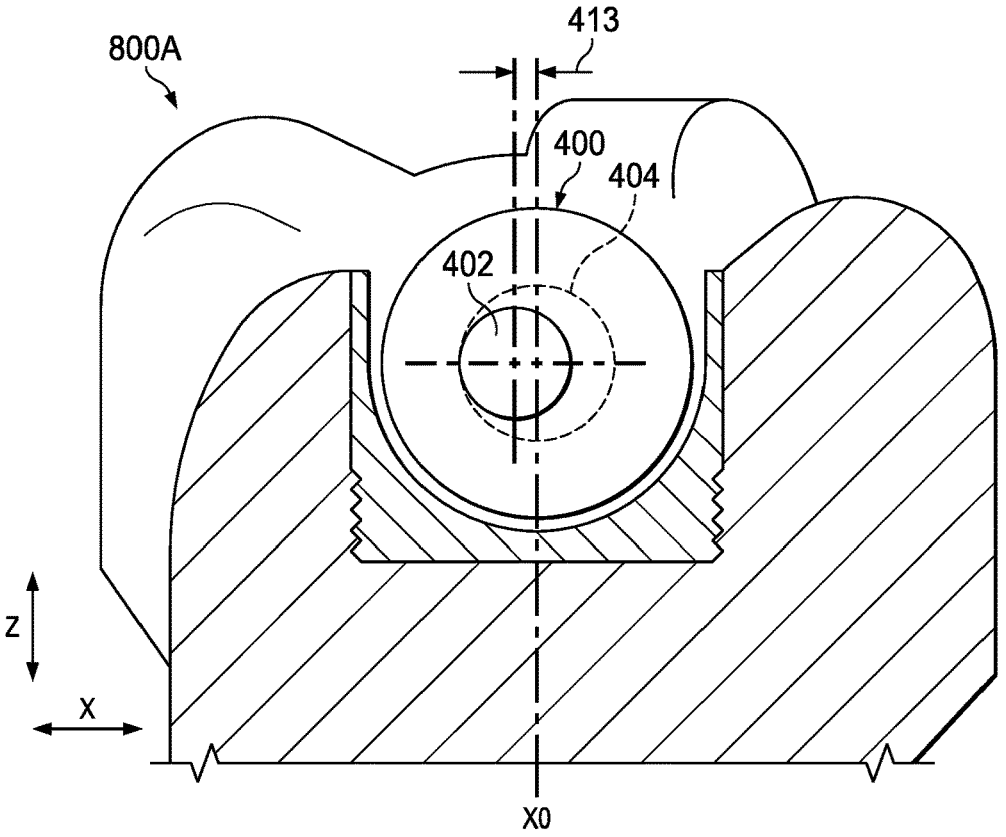
FIGS. 8A-8C are partial cross-sectional side views of drill bits having rolling cutter assemblies with offset axes, in accordance with one or more aspects of the present disclosure.
Figure 8B:
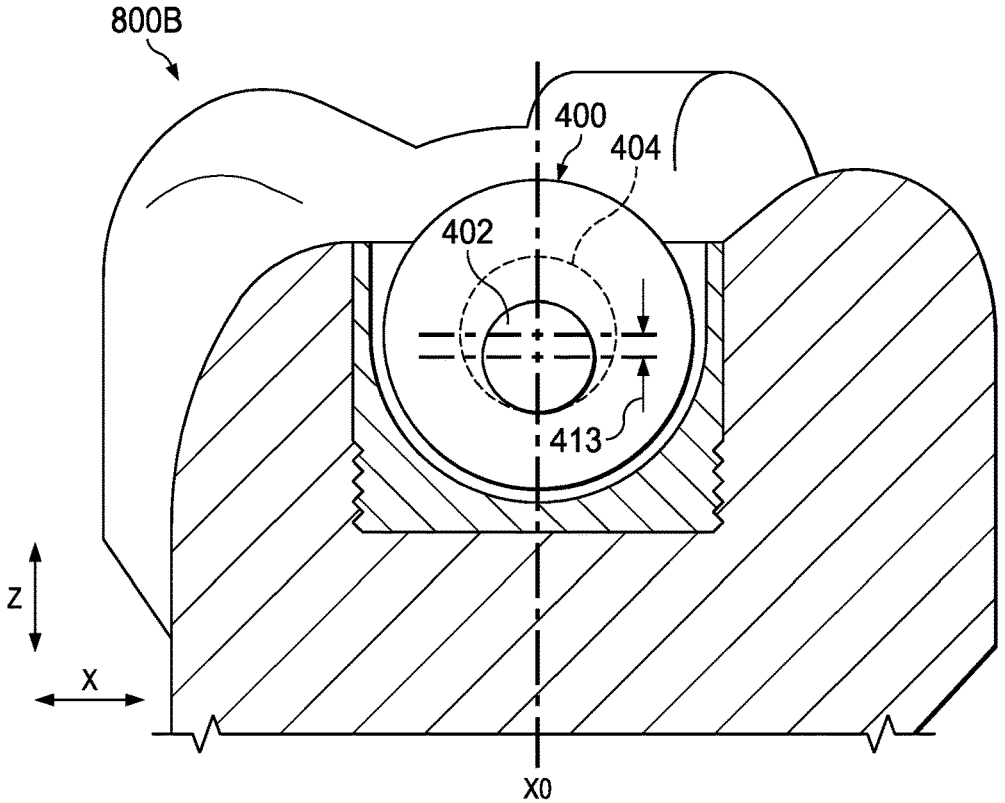
Figure 8C:
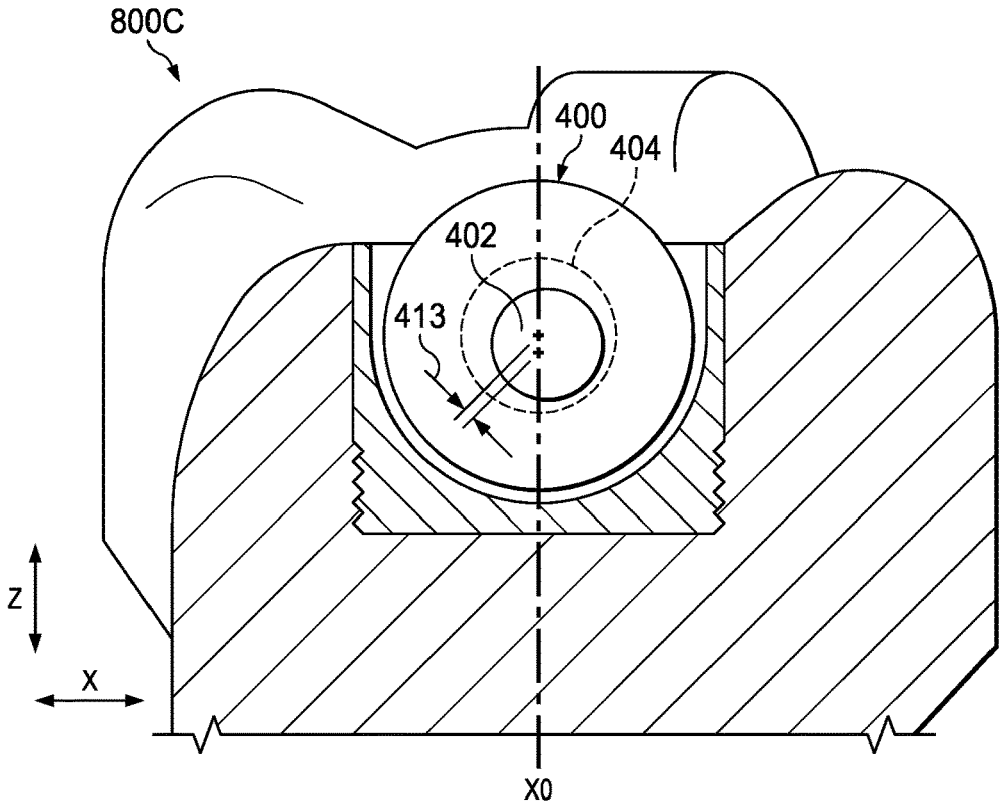

In FIGS. 4A-7, the axles 400 are illustrated as having an offset 413 between the first and second axle portions 402 and 404 in the same x-direction. It should be noted that the drill bits may be configured to receive the resulting cutter assembly 600 to provide a desired orientation of the offset 413 with respect to the drill bit. For example, FIGS. 8A-8C illustrate drill bits 800A-800C having rolling cutter assemblies with different orientations of the offset axle 400. In FIGS. 8A-8C, the z-direction is parallel to an axis of rotation X0 of the drill bit, and the x-direction is perpendicular to both the z-direction and the longitudinal direction (y-direction) of the axes of the axle portions 402 and 404. Each of FIGS. 8A-8C show a cutaway/partial cross-section viewed from the longitudinal direction (y-direction) in which the axle 400 extends.

In FIG. 8A, the offset 413 between axes of the first axle portion 402 and the second axle portion 404 is entirely in the x-direction. That is, when viewed from the longitudinal direction, the central axis of the first axle portion 402 is offset from the central axis of the second axle portion 404 in a direction perpendicular to the rotational axis X0 of the drill bit 800A.

In FIG. 8B, the offset 413 between axes of the first axle portion 402 and the second axle portion 404 is entirely in the z-direction. That is, when viewed from the longitudinal direction, the central axis of the first axle portion 402 is offset from the central axis of the second axle portion 404 in a direction parallel to the rotational axis X0 of the drill bit 800B. This type of offset may provide a desired unequal loading to the subterranean formation.

In FIG. 8C, the offset 413 between axes of the first axle portion 402 and the second axle portion 404 is in both the x- and z-directions. That is, when viewed from the longitudinal direction, the central axis of the first axle portion 402 is offset from the central axis of the second axle portion 404 in both a direction parallel to the rotational axis X0 of the drill bit 800C and a direction perpendicular to the rotational axis X0 of the drill bit 800C.

Figure 9:
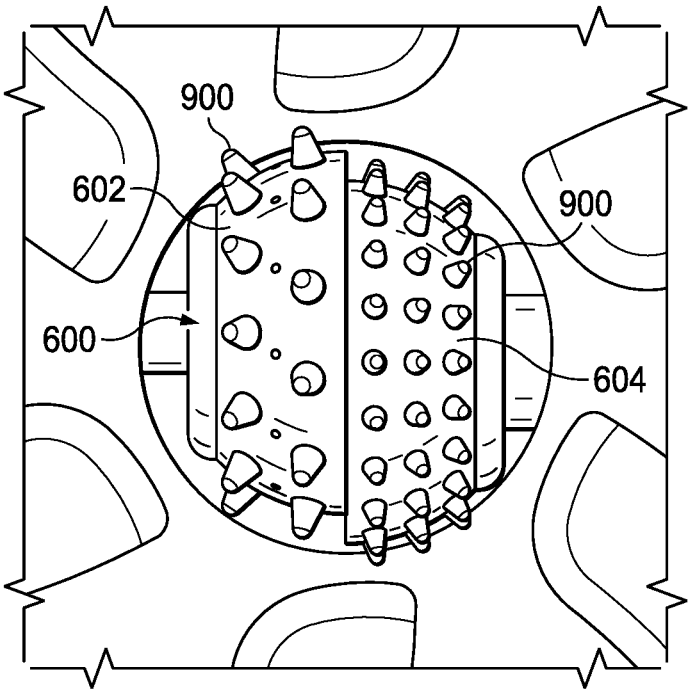
FIG. 9 is a top view of an example pair of cutters used in a rolling cutter assembly, in accordance with one or more aspects of the present disclosure.
Figure 10:
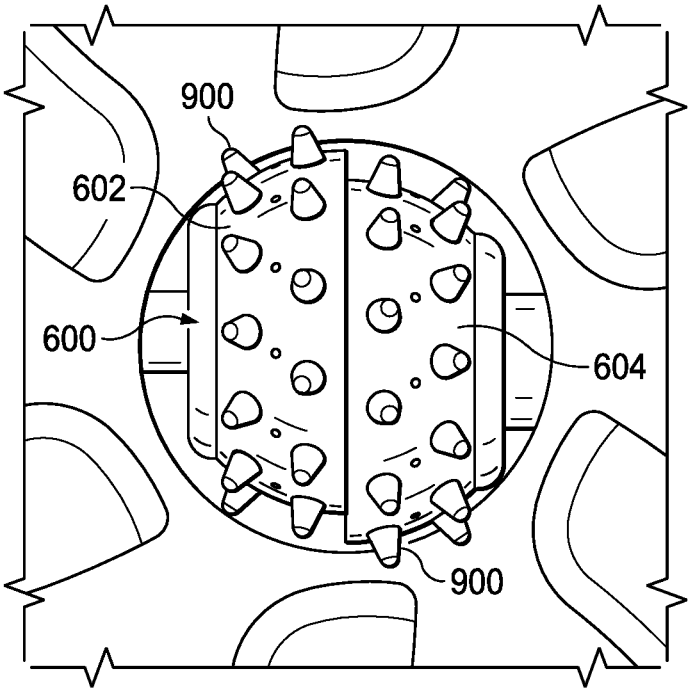
FIG. 10 is a top view of another example pair of cutters used in a rolling cutter assembly, in accordance with one or more aspects of the present disclosure.

FIGS. 9 and 10 illustrate different types of rotatable cutters 602 and 604 that may be used in the cutter assemblies 600 and drill bits described herein. As shown in FIG. 9, the cutters 602 and 604 may each have a similar overall cutting profile, but with different types of cutting elements (i.e., different cutting structures) thereon. In other embodiments, as shown in FIG. 10, the cutters 602 and 604 may each have a similar overall cutting profile and the same or similar cutting elements thereon. In any of the cutters 602 and 604, the cutting edge (i.e., radially outward facing edge) thereof may include cutting structures 900. The cutting structures may include, for example, shaped cutting structures that protrude outward (e.g., mill teeth or other protrusions formed in the overall shape of the cutter), ultrahard material inserts (e.g., tungsten carbide or PDC cutting inserts), or a combination thereof.

Figure 11A:
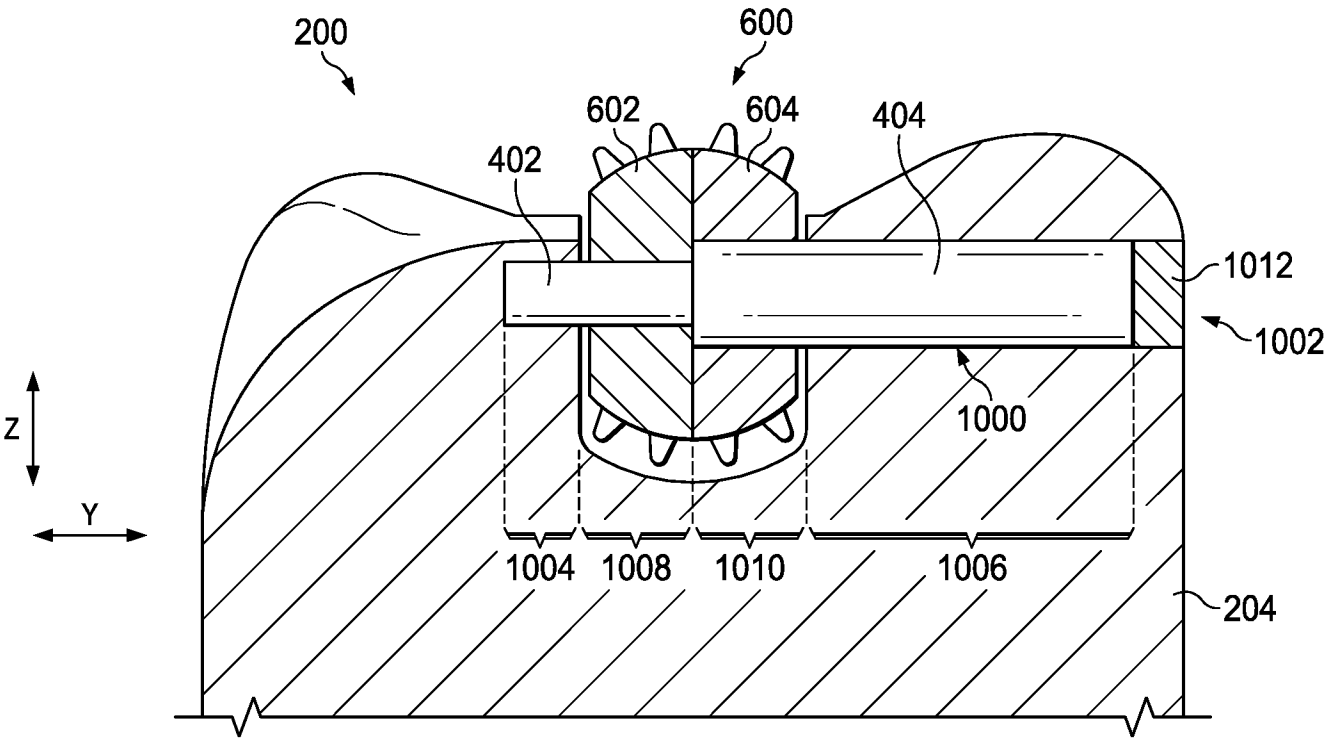
FIG. 11A is a partial cross-sectional view of a fully assembled drill bit, in accordance with one or more aspects of the present disclosure.
Figure 11B:
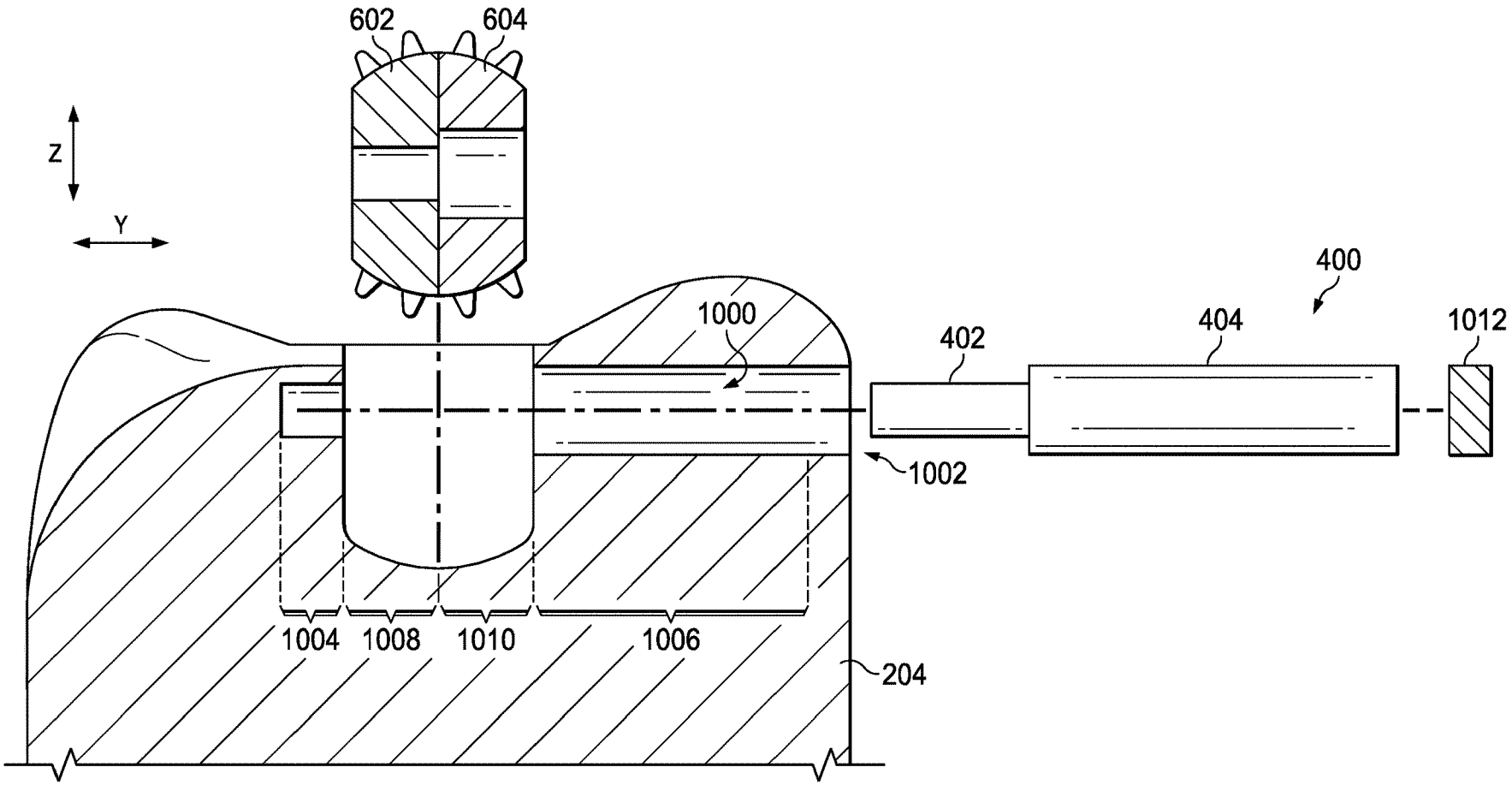
FIG. 11B is a partial cross-sectional exploded view of the drill bit of FIG. 11A, in accordance with one or more aspects of the present disclosure.

FIGS. 11A and 11B illustrate how the rotating cutter assembly 600 with the offset axle 400 may be disposed in a bit body 204 during the manufacture of a hybrid drill bit 200. Similar techniques may be used for installing the cutter assembly 600 with the offset axle 400 in a bit body during manufacture of a rotating cutter drill bit (e.g., 300 of FIG. 3). The rotating cutter assembly 600 may be inserted into the bit body 204 at the end of the manufacturing process for the drill bit 200. The use of a single, continuous, offset axle 400 makes the manufacturing process relatively easy compared to prior offset cutters that had multiple smaller pieces that had to be precisely fit together.

The bit body 204 may have an opening 1000 formed therethrough in which the axle 400 is secured in the bit body 204. As illustrated, the opening 1000 may extend from one side 1002 of the bit body 204. This is in contrast to hybrid drill bits that use an opening from the back (i.e., upper end) of the bit body and through a central cavity in the bit body. The opening 1000 in the bit body 204 may have a first portion 1004 designed to hold the first axle portion 402 and a second portion 1006 designed to hold the second axle portion 404. The first portion 1004 has a smaller diameter than the second portion 1006 of the opening 1000. The second portion 1006 of the opening 1000 may extend through the side 1002 of the bit body 204. The relative size and positions of the first and second portions 1004, 1006 of the opening 1000 may match the relative size and position of the offset axle portions 402, 404. The exact positioning of the first and second portions 1004, 1006 of the opening 1000 formed in the bit body 204 determine the offset of the axle 400 and the cutters 602, 604 relative to the rest of the drill bit 200.

The opening 1000 in the bit body 204 may also have a third portion 1008 designed to hold the first cutter 602 and a fourth portion 1010 designed to hold the second cutter 604. The third and fourth portions 1008, 1010 are located between the first and second portions 1004, 1006 as shown. The third and fourth portions 1008, 1010 of the opening 1000 may each extend through the bit body 204 at its longitudinal end (with respect to X0), thereby allowing the cutters 602 and 604 to extend out from the bit body 204 and engage the subterranean formation. Although not visible in FIGS. 11A and 11B, the third and fourth portions 1008, 1010 of the opening 1000 may be offset from each other in the same direction that the cutters 602 and 604 are offset from each other.

When the axle 400 and cutters 602 and 604 are positioned in the bit body 204, as shown in FIG. 11A, there may be gaps present around the edges of the axle 400 to allow drilling mud pumped through the drill bit 200 to lubricate the cutters 602 and 604. The opening 1000 may be machined or otherwise sized to provide this gap. Upon assembly of the drill bit 200, the axle 400 may be permanently fixed in place, or it may be removable. The drill bit 200 may include a retaining mechanism 1012 used to either permanently or selectively retain the axle 400 in the opening 1000. The retaining mechanism 1012 may include, for example, a snap ring, a weld, one or more bolts or other fasteners, a threaded plug, an interference fit plug, glue, or a combination thereof. The retaining mechanism 1012 need not be positioned all the way at the side 1002 of the bit body 204, as shown, but may include one or more components located further inside the opening 1000.

FIG. 11B demonstrates the process of loading the rotating cutter assembly 600 into the drill bit 200. First, the cutters 602 and 604 may be lowered into the third and fourth portions 1008 and 1010, respectively, of the opening 1000. The cutters 602 and 604 may be lowered into their appropriate portions of the opening 1000 separately, or they may be lowered together. In some instances, the cutters 602 and 604 may be taped or otherwise secured together in a desired position with respect to each other to allow for more easy assembly of the axle 400 into the bit body 204. Then, after inserting the axle 400 the tape or other securing mechanism may be removed, allowing the cutters 602 and 604 to roll with respect to one another. With the cutters 602 and 604 in place, the axle 400 is then inserted into the opening 1000 and keyed into its final position in the bit body 204. In particular, the axle 400 may be passed through the opening 1000, starting with the smaller first axle portion 402. The first axle portion 402 is inserted through the side 1002 of the bit body 204 and passed through the second portion 1006 of the opening 1000, the hole in the second cutter 604, and finally into a position within the first portion 1004 of the opening 1000 and the hole in the first cutter 602. The second axle portion 404 (connected to the first axle portion 402), follows into the larger second portion 1006 of the opening 1000 and the hole in the second cutter 604. During insertion, the axle 400 may be rotated as needed to align the first axle portion 402 with the first portion 1004 of the opening and the second axle portion 404 with the second portion 1006 of the opening 1000. The axle 400 is then secured in place in the bit body 204 via the retaining mechanism 1012. In some embodiments, the axle 400 may later be removed from the bit body 204 by undoing the retaining mechanism 1012 and sliding the axle 400 out of the opening 1000 in the bit body 204. Selective removal of the axle 400 may enable replacement of the cutters 602 and 604. For example, if the cutters 602 and 604 become dull or broken during operation of the drill bit 200, the axle 400 may be removed and the cutters 602 and 604 replaced with a new pair of cutters. Then, the drill bit 200 with the new cutters may be used to continue drilling the wellbore or to drill a different wellbore.

One or more aspects of the present disclosure provide a drill bit. The drill bit includes a bit body and an axle disposed in the bit body. The axle includes a first axle portion extending in a longitudinal direction and a second axle portion extending in the longitudinal direction. A longitudinal end of the first axle portion is continuous with a longitudinal end of the second axle portion. When viewed from the longitudinal direction, the first axle portion and the second axle portion are not coaxial, and an outer perimeter of the first axle portion is located entirely within an outer perimeter of the second axle portion. The drill bit further includes a first cutter disposed on the first axle portion and a second cutter disposed on the second axle portion. In one or more aspects, when viewed from the longitudinal direction, at least a point on the outer perimeter of the first axle portion intersects the outer perimeter of the second axle portion.

In one or more aspects, when viewed from the longitudinal direction, no point along the outer perimeter of the first axle portion intersects the outer perimeter of the second axle portion.

In one or more aspects, the first axle portion has a circular cross section and the second axle portion has a circular cross section.

In one or more aspects, the first and second cutters are rotatable about the first and second portions of the axle, respectively.

In one or more aspects, the first and second cutters have the same cutting profile with shaped cutting structures or ultrahard material inserts.

In one or more aspects, a cutting edge of the first cutter is offset from a cutting edge of the second cutter.

In one or more aspects, when viewed from the longitudinal direction, an outer diameter of the first cutter is substantially equal to an outer diameter of the second cutter.

In one or more aspects, the first cutter and the second cutter have different cutting structures.

In one or more aspects, when viewed from the longitudinal direction, a radial distance from a radially outer edge to a radially inner edge of the first cutter is substantially equal to a radial distance from a radially outer edge to a radially inner edge of the second cutter.

In one or more aspects, when viewed from the longitudinal direction, a central axis of the first axle portion is offset from a central axis of the second axle portion in a direction parallel to a longitudinal axis of the drill bit.

In one or more aspects, when viewed from the longitudinal direction, a central axis of the first axle portion is offset from a central axis of the second axle portion in a direction perpendicular to a longitudinal axis of the drill bit.

In one or more aspects, when viewed from the longitudinal direction, a central axis of the first axle portion is offset from a central axis of the second axle portion in both a direction parallel to a longitudinal axis of the drill bit and a direction perpendicular to the longitudinal axis of the drill bit.

In one or more aspects, the bit body has an opening therethrough in which the axle is secured in the bit body, the opening extending through one side of the bit body.

In one or more aspects, the opening in the bit body has a first portion holding the first axle portion and a second portion holding the second axle portion, wherein the first portion of the opening has a smaller diameter than the second portion of the opening, and wherein the second portion of the opening extends through the one side of the bit body.

In one or more aspects, the opening in the bit body has a third portion holding the first cutter and a fourth portion holding the second cutter, the third and fourth portions are located between the first and second portions, and the third and fourth portions extend through the bit body at a longitudinal end of the drill bit.

In one or more aspects, the drill bit further includes a plurality of cutting inserts fixed to the bit body.

One or more aspects of the present disclosure also provide a method of drilling a wellbore. The method includes lowering a drill bit into a subterranean formation. The drill bit includes a bit body and an axle disposed in the bit body. The axle includes a first axle portion extending in a longitudinal direction and a second axle portion extending in the longitudinal direction. A longitudinal end of the first axle portion is continuous with a longitudinal end of the second axle portion. When viewed from the longitudinal direction, the first axle portion and the second axle portion are not coaxial, and an outer perimeter of the first axle portion is located entirely within an outer perimeter of the second axle portion. The drill bit further includes two cutters disposed one on each of the first axle portion and the second axle portion. The method further includes forming the wellbore by cutting through the subterranean formation at least partially via the two cutters.

In one or more aspects, the method further includes removing the axle from the bit body.

In one or more aspects, the method further includes replacing the two cutters with a new pair of cutters and drilling the wellbore with the drill bit having the new pair of cutters.

In one or more aspects, the method further includes lubricating the two cutters via drilling fluid pumped through the drill bit while drilling the wellbore.

One or more aspects of the present disclosure also provide a cutter assembly for use in a drill bit. The cutter assembly includes an axle configured to be disposed in a bit body of the drill bit. The axle includes a first axle portion extending in a longitudinal direction, and a second axle portion extending in the longitudinal direction. A longitudinal end of the first axle portion is continuous with a longitudinal end of the second axle portion. When viewed from the longitudinal direction, the first axle portion and the second axle portion are not coaxial, and an outer perimeter of the first axle portion is located entirely within an outer perimeter of the second axle portion. The cutter assembly further includes two cutters configured to be disposed one on each of the first axle portion and the second axle portion.

Therefore, the present disclosure is well adapted to attain the ends and advantages mentioned as well as those that are inherent therein. The particular aspects disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the elements that it introduces.

What is claimed is:

1. A hybrid drill bit, comprising:

a bit body having an opening, wherein the opening comprises a first opening portion, a second opening portion, a third opening portion, and a fourth opening portion, wherein the third opening portion and the fourth opening portion extend axially into the bit body to form a cutter pocket in the bit body; wherein the second opening portion extends longitudinally into the bit body from a first side of the bit body to the fourth opening portion, and wherein the first opening portion extends partially into the bit body from the third opening portion in a longitudinal direction;

an axle disposed in the opening of the bit body, the axle comprising:

a first axle portion extending in a longitudinal direction and secured at least partially within the first opening portion; and a second axle portion extending in the longitudinal direction and secured at least partially within the second opening portion, wherein a longitudinal end of the first axle portion is continuous with a longitudinal end of the second axle portion;

wherein, when viewed from the longitudinal direction:

the first axle portion and the second axle portion are not coaxial, an outer perimeter of the first axle portion is located entirely within an outer perimeter of the second axle portion, and wherein no point along the outer perimeter of the first axle portion intersects the outer perimeter of the second axle portion;

a first cutter disposed on the first axle portion and positioned at least partially within the third opening portion; and a second cutter disposed on the second axle portion and positioned at least partially within the fourth opening portion.

2. The drill bit of claim 1, wherein, when viewed from the longitudinal direction, at least a point on the outer perimeter of the first axle portion intersects the outer perimeter of the second axle portion.

3. The drill bit of claim 1, wherein the first and second cutters are rotatable about the first and second portions of the axle, respectively.

4. The drill bit of claim 3, wherein a cutting edge of the first cutter is offset from a cutting edge of the second cutter.

5. The drill bit of claim 3, wherein, when viewed from the longitudinal direction, an outer diameter of the first cutter is substantially equal to an outer diameter of the second cutter.

6. The drill bit of claim 5, wherein the first cutter and the second cutter have different cutting structures.

7. The drill bit of claim 5, wherein the first and second cutters have the same cutting profile with shaped cutting structures or ultrahard material inserts.

8. The drill bit of claim 3, wherein a radial distance from a radially outer edge to a radially inner edge of the first cutter is substantially equal to a radial distance from a radially outer edge to a radially inner edge of the second cutter.

9. The drill bit of claim 1, wherein, when viewed from the longitudinal direction, a central axis of the first axle portion is offset from a central axis of the second axle portion in a direction parallel to a longitudinal axis of the bit body.

10. The drill bit of claim 1, wherein, when viewed from the longitudinal direction, a central axis of the first axle portion is offset from a central axis of the second axle portion in a direction perpendicular to a longitudinal axis of the bit body.

11. The drill bit of claim 1, wherein, when viewed from the longitudinal direction, a central axis of the first axle portion is offset from a central axis of the second axle portion in both a direction parallel to a longitudinal axis of the bit body and a direction perpendicular to the longitudinal axis of the bit body.

12. The drill bit of claim 1, wherein the first opening portion has a smaller diameter than the second opening portion.

13. The drill bit of claim 1, further comprising a plurality of cutting inserts fixed to the bit body.

14. A method of drilling a wellbore, comprising:

lowering a hybrid drill bit into a subterranean formation, the hybrid drill bit comprising:

a bit body having an opening, wherein the opening comprises a first opening portion, a second opening portion, a third opening portion, and a fourth opening portion, wherein the third opening portion and the fourth opening portion extend axially into the bit body to form a cutter pocket in the bit body; wherein the second opening portion extends longitudinally into the bit body from a first side of the bit body to the fourth opening portion, wherein the first opening portion extends partially into the bit body from the third opening portion in a longitudinal direction, and wherein the first opening portion includes a smaller diameter than the second opening portion;

an axle disposed in the opening of the bit body, the axle comprising:

a first axle portion extending in a longitudinal direction and secured at least partially within the first opening portion; and a second axle portion extending in the longitudinal direction and secured at least partially within the second opening portion, wherein a longitudinal end of the first axle portion is continuous with a longitudinal end of the second axle portion;

wherein, when viewed from the longitudinal direction:

the first axle portion and the second axle portion are not coaxial, an outer perimeter of the first axle portion is located entirely within an outer perimeter of the second axle portion, and wherein no point along the outer perimeter of the first axle portion intersects the outer perimeter of the second axle portion; and a first cutter disposed on the first axle portion and positioned at least partially within the third opening portion;

a second cutter disposed on the second axle portion and positioned at least partially within the fourth opening portion; and forming the wellbore by cutting through the subterranean formation at least partially via the two cutters.

15. The method of claim 14, further comprising removing the axle from the bit body.

16. The method of claim 15, further comprising replacing the first cutter and the second cutter with a new pair of cutters and drilling the wellbore with the drill bit having the new pair of cutters.

17. A hybrid drill bit, comprising:

a bit body having an opening, wherein the opening comprises a first opening portion, a second opening portion, a third opening portion, and a fourth opening portion, wherein the third opening portion and the fourth opening portion extend axially into the bit body to form a cutter pocket in the bit body; wherein the second opening portion extends longitudinally into the bit body from a first side of the bit body to the fourth opening portion, wherein the first opening portion extends partially into the bit body from the third opening portion in a longitudinal direction, and wherein the first opening portion has a smaller diameter than the second opening portion;

an axle disposed in the opening of the bit body of the drill bit, the axle comprising:

a first axle portion extending in a longitudinal direction and secured at least partially within the first opening portion; and a second axle portion extending in the longitudinal direction and secured at least partially within the second opening portion, wherein the second axle portion has a larger diameter than the first opening portion, wherein a longitudinal end of the first axle portion is continuous with a longitudinal end of the second axle portion;

wherein, when viewed from the longitudinal direction:

the first axle portion and the second axle portion are not coaxial, an outer perimeter of the first axle portion is located entirely within an outer perimeter of the second axle portion, and a central axis of the first axle portion is offset from a central axis of the second axle portion in a direction parallel to a longitudinal axis of the bit body;

a first cutter disposed on the first axle portion and positioned at least partially within the third opening portion; and a second cutter disposed on the second axle portion and positioned at least partially within the fourth opening portion.

* * * * *